US006471439B2

(12) United States Patent
Allamon et al.

(10) Patent No.: US 6,471,439 B2
(45) Date of Patent: Oct. 29, 2002

(54) SLIPS FOR DRILL PIPES OR OTHER TUBULAR MEMBERS

(75) Inventors: Jerry P. Allamon, 34 Naples La., Montgomery, TX (US) 77356; Jack E. Miller, Houston, TX (US)

(73) Assignees: Jerry P. Allamon, Montgomery, TX (US); Shirley C. Allamon, Montgomery, TX (US)

( * ) Notice: Subject to any disclaimer, the term of this patent is extended or adjusted under 35 U.S.C. 154(b) by 0 days.

(21) Appl. No.: 10/042,411

(22) Filed: Jan. 8, 2002

(65) Prior Publication Data

US 2002/0061224 A1 May 23, 2002

Related U.S. Application Data

(63) Continuation of application No. 09/863,691, filed on May 23, 2001.
(60) Provisional application No. 60/180,361, filed on Feb. 4, 2000.

(51) Int. Cl.[7] ..... F16B 2/14; F16B 2/04
(52) U.S. Cl. ..... 403/374.1; 285/123.5
(58) Field of Search ..... 403/367, 297, 403/298, 374.1; 285/141.1, 142.1, 143.1, 144.1, 145.1–145.5, 146.1–146.3, 147.1–147.3, 148.1–148.28, 123.5–123.11; 174/423

(56) References Cited

U.S. PATENT DOCUMENTS

| | | | | |
|---|---|---|---|---|
| 565,843 | A | 8/1896 | Curtin | 252/23 |
| 823,974 | A | 6/1906 | Shaw | 252/23 |
| 1,058,577 | A | 4/1913 | Gardner | 252/23 |
| 1,149,034 | A | 8/1915 | Despain | 252/23 |
| 1,298,619 | A | 3/1919 | Wright | 252/23 |
| 1,341,410 | A | 5/1920 | Black | 252/23 |
| 1,414,951 | A | 5/1922 | Hosmer et al. | 252/23 |
| 1,422,289 | A | 7/1922 | Moody | 252/23 |

(List continued on next page.)

OTHER PUBLICATIONS

Drawing No. 70550, entitled *Slip Segment Assembly*, dated Nov. 16, 1998.
Drawing No. 70071, entitled *Slip Body, 9–5/8 in.* (*Machining*), Dated Jan. 14, 1999.
Varco Drawing No. 70562, Sheet 1 of 3, entitled *Retainer Insert*, dated Jan. 7, 1985.
Varco Drawing No. 70562, Sheet 2 of 3, entitled *Retainer Insert*, dated Jan. 7, 1985.
Varco Drawing No. 70562, Sheet 3 of 3, entitled *Retainer Insert*, dated Jan. 7, 1985.
Varco® Oil Tools, *1000 Ton Casing Elavator/Spider For 8–5/8 inc. Thru 20–in. OD Casing*, Service Manual, M–70100, 5/81.

*Primary Examiner*—Anthony Knight
*Assistant Examiner*—John B. Walsh
(74) *Attorney, Agent, or Firm*—Jackson Walker; Clarence E. Eriksen

(57) ABSTRACT

The present invention relates to improvements in drill slip assemblies for use in holding a drill pipe or other tubular member in a vertical position above or within a wellbore. The invention comprises a plurality of slip segments assembled in a slip bowl, each segment containing a plurality of dies which grip the tubular member to prevent any axial displacement. The invention provides at least three improvements over prior art drill slips. First, the outer surface of the slip segment assembly, particularly the lower nose region, is fully supported by the inner surface of the slip bowl such that no portion of the slip segment assembly extends below the bowl. Second, the slip segments are fabricated from forged steel, making them more durable and able to carry higher loads. Third, each die in the lowermost set of hardened dies is fabricated having a rounded bottom end with a tapered profile to complement the rounded bottom of the axial grooves cut into each slip segment.

16 Claims, 7 Drawing Sheets

U.S. PATENT DOCUMENTS

| | | | | |
|---|---|---|---|---|
| 1,442,663 | A | 1/1923 | Halley | 252/23 |
| 1,481,378 | A | 1/1924 | Le Bus | 252/23 |
| 1,482,693 | A | 2/1924 | Mollenberg | 252/23 |
| 1,501,962 | A | 7/1924 | Montgomery | 252/23 |
| 1,503,523 | A | 8/1924 | Thomas et al. | 252/23 |
| 1,506,581 | A | 8/1924 | Halley | 252/23 |
| 1,535,689 | A | 4/1925 | Schwimmer | 252/23 |
| 1,543,904 | A | 6/1925 | Carr | 252/23 |
| 1,555,379 | A | 9/1925 | Moody | 252/23 |
| 1,560,701 | A | 11/1925 | Layton | 252/23 |
| 1,574,404 | A | 2/1926 | Moody | 252/23 |
| 1,611,599 | A | 12/1926 | Livergood | 252/23 |
| 1,625,540 | A | 4/1927 | Hertzberg | 252/23 |
| 1,637,056 | A | 7/1927 | Segelhorst | 252/23 |
| 1,643,750 | A | 8/1927 | Pearson et al. | 252/23 |
| 1,659,639 | A | 1/1928 | Smith | 252/23 |
| 1,659,783 | A | 2/1928 | Pearce | 252/23 |
| 1,685,284 | A | 9/1928 | Harding | 252/23 |
| 1,704,057 | A | 3/1929 | Neilsen | 252/23 |
| 1,719,533 | A | 7/1929 | Cady | 252/23 |
| 1,725,666 | A | 8/1929 | Morrow | 252/23 |
| 1,730,622 | A | 10/1929 | O'Brien | 252/23 |
| 1,737,893 | A | 12/1929 | Reed | 252/23 |
| 1,750,822 | A | 3/1930 | Spalding | 252/23 |
| 1,758,108 | A | 5/1930 | Goeser | 252/23 |
| 1,763,872 | A | 7/1930 | Uhrig | 252/23 |
| 1,776,043 | A | 9/1930 | Reed | 252/23 |
| 1,794,273 | A | 2/1931 | Black | 252/23 |
| 1,795,578 | A | 3/1931 | Smith | 252/23 |
| 1,797,964 | A | 3/1931 | Pearce | 252/23 |
| 1,802,156 | A | 4/1931 | O'Brien | 252/23 |
| 1,820,479 | A | 8/1931 | O'Brien | 252/23 |
| 1,823,183 | A | 9/1931 | Angell | 252/23 |
| 1,836,680 | A | 12/1931 | Nixon | 252/23 |
| 1,838,439 | A | 12/1931 | O'Brien | 252/23 |
| 1,847,087 | A | 3/1932 | Greve | 252/23 |
| 1,849,102 | A | 3/1932 | Livergood | 252/23 |
| 1,851,009 | A | 3/1932 | Hoffoss | 252/23 |
| 1,858,324 | A | 5/1932 | Decker | 252/23 |
| 1,860,062 | A | 5/1932 | Taylor | 252/23 |
| 1,864,111 | A | 6/1932 | Young | 252/23 |
| 1,864,953 | A | 6/1932 | Standlee | 252/23 |
| 1,874,440 | A | 8/1932 | Bush | 252/23 |
| 1,883,073 | A | 10/1932 | Stone | 252/23 |
| 1,889,592 | A | 11/1932 | Brandt | 252/23 |
| 1,907,685 | A | 5/1933 | Tilbury | 252/23 |
| 1,909,601 | A | 5/1933 | Young et al. | 252/23 |
| 1,920,617 | A | 8/1933 | Young et al. | 24/263 |
| 1,923,283 | A | 8/1933 | Stokes | 24/263 |
| 1,933,172 | A | 10/1933 | Humason | 24/263 |
| 1,952,595 | A | 3/1934 | Johnson | 24/263 |
| 1,966,454 | A | 7/1934 | Moody | 24/263 |
| 1,966,693 | A | 7/1934 | Tilbury | 24/263 |
| 1,979,389 | A | 11/1934 | Howard | 24/263 |
| 1,999,279 | A | 4/1935 | Burns et al. | 24/263 |
| 2,010,938 | A | 8/1935 | Abegg | 24/263 |
| 2,012,329 | A | 8/1935 | Wickersham et al. | 24/263 |
| 2,012,337 | A | 8/1935 | Burns et al. | 24/263 |
| 2,023,663 | A | 12/1935 | Burns et al. | 24/263 |
| 2,030,499 | A | 2/1936 | Church | 24/263 |
| 2,048,209 | A | 7/1936 | Young et al. | 24/263 |
| 2,061,772 | A | 11/1936 | McLagan | 24/263 |
| 2,063,361 | A | 12/1936 | Baash | 24/263 |
| 2,065,130 | A | 12/1936 | Grau et al. | 24/263 |
| 2,065,140 | A | 12/1936 | Lundeen | 24/263 |
| 2,071,637 | A | 2/1937 | Laurent | 24/263 |
| 2,085,237 | A | 6/1937 | Todd | 24/263 |
| 2,109,493 | A | 3/1938 | Lundeen | 24/263 |
| 2,119,731 | A | 7/1938 | Abegg | 24/263 |
| 2,131,400 | A | 9/1938 | Johnson et al. | 24/263 |
| 2,134,468 | A | 10/1938 | Bashara | 24/263 |
| 2,143,615 | A | 1/1939 | Abegg | 24/263 |
| 2,143,849 | A | 1/1939 | Gordy, Jr. | 24/263 |
| 2,144,146 | A | 1/1939 | Driscoll | 24/263 |
| 2,151,208 | A | 3/1939 | Hiniker | 24/263.5 |
| 2,153,770 | A | 4/1939 | Nixon | 24/263 |
| 2,156,384 | A | 5/1939 | Fluellen | 24/263 |
| 2,184,231 | A | 12/1939 | Allen | 24/263 |
| 2,208,926 | A | 7/1940 | Fluellen | 24/263 |
| 2,231,923 | A | 2/1941 | Koen | 24/263 |
| 2,245,979 | A | 6/1941 | Johnson | 24/263.5 |
| 2,259,054 | A | 10/1941 | Young | 24/263 |
| 2,282,758 | A | 5/1942 | Gallagher | 24/263 |
| 2,283,082 | A | 5/1942 | Miether | 24/263 |
| 2,287,432 | A | 6/1942 | Kinzbach | 24/263 |
| 2,288,851 | A | 7/1942 | Sharp | 24/263 |
| 2,293,974 | A | 8/1942 | Eckel | 166/1 |
| 2,303,312 | A | 11/1942 | Sheffield | 254/30 |
| 2,319,016 | A | 5/1943 | Taylor | 24/263 |
| 2,340,597 | A | 2/1944 | Kelley | 24/263 |
| 2,351,887 | A | 6/1944 | Steadman | 255/23 |
| 2,545,177 | A | 3/1951 | True | 24/263 |
| 2,545,627 | A | 3/1951 | Moore | 255/23 |
| 2,552,618 | A | 5/1951 | Boatright | 24/263 |
| 2,570,039 | A | 10/1951 | Stone | 24/263 |
| 2,573,318 | A | 10/1951 | Dow | 40/125 |
| 2,575,649 | A | 11/1951 | Abegg | 24/263 |
| 2,589,159 | A | 3/1952 | Stone | 255/23 |
| 2,609,583 | A | 9/1952 | Barber et al. | 24/263 |
| 2,612,671 | A | 10/1952 | Martin | 24/263 |
| 2,662,737 | A | 12/1953 | Edelberg | 255/23 |
| RE23,842 | E | 6/1954 | Moore | 252/23 |
| 2,698,734 | A | 1/1955 | Tremolada et al. | 255/23 |
| 2,700,201 | A | 1/1955 | Bannister | 24/263 |
| 2,785,454 | A | 3/1957 | Young | 24/263 |
| 2,810,178 | A | 10/1957 | Taylor | 24/263 |
| 2,810,551 | A | 10/1957 | Long | 255/23 |
| 2,810,552 | A | 10/1957 | Martin | 255/23 |
| 2,814,087 | A | 11/1957 | Palmer | 24/263 |
| 2,814,461 | A | 11/1957 | Martin | 255/23 |
| 2,839,164 | A | 6/1958 | Roussel | 188/67 |
| 2,874,436 | A | 2/1959 | Allen | 24/263 |
| 2,874,437 | A | 2/1959 | Anderson | 24/263 |
| 2,887,754 | A | 5/1959 | Johnson | 24/263 |
| 2,890,513 | A | 6/1959 | Lane | 24/263 |
| 2,896,292 | A | 7/1959 | Kinzbach | 24/249 |
| 2,905,998 | A | 9/1959 | Acker, Jr. | 24/254 |
| 2,908,514 | A | 10/1959 | Davis | 285/146 |
| 2,970,445 | A | 2/1961 | Suderow | 61/46.5 |
| 3,017,936 | A | 1/1962 | Long | 175/197 |
| 3,019,502 | A | 2/1962 | Walker | 24/263 |
| 3,025,582 | A | 3/1962 | Taylor | 24/263 |
| 3,029,488 | A | 4/1962 | Knights | 24/263 |
| 3,032,366 | A | 5/1962 | Meek | 294/102 |
| 3,052,943 | A | 9/1962 | Jones | 24/263 |
| 3,095,627 | A | 7/1963 | Johnson | 24/263 |
| 3,096,075 | A | 7/1963 | Brown | 254/29 |
| 3,096,554 | A | 7/1963 | Johnson | 24/263 |
| 3,097,409 | A | 7/1963 | Kelley | 24/263 |
| 3,122,811 | A | 3/1964 | Gilreath | 24/263 |
| 3,140,523 | A | 7/1964 | Taylor | 24/263 |
| 3,149,391 | A | 9/1964 | Boster | 24/263 |
| 3,156,026 | A | 11/1964 | Kelley | 24/263 |
| 3,210,821 | A | 10/1965 | Spiri et al. | 24/263 |
| 3,268,968 | A | 8/1966 | Crickmer | 24/263 |
| 3,268,969 | A | 8/1966 | Turner | 24/263 |
| 3,270,389 | A | 9/1966 | Kingsbury | 24/263 |
| 3,348,277 | A | 10/1967 | Crickmer | 24/263 |
| 3,349,455 | A | 10/1967 | Doherty | 24/263 |
| 3,353,235 | A | 11/1967 | Adams | 24/263 |
| 3,358,341 | A | 12/1967 | Burstall | 24/263 |

| | | | | |
|---|---|---|---|---|
| 3,365,762 | A | 1/1968 | Spiri | 24/263 |
| 3,367,002 | A | 2/1968 | Johnson | 24/263 |
| 3,422,506 | A | 1/1969 | Turner | 24/263 |
| 3,443,291 | A | 5/1969 | Doherty | 24/263 |
| 3,454,289 | A | 7/1969 | Fowler | 285/144 |
| 3,457,605 | A | 7/1969 | Kingsbury et al. | 24/263 |
| 3,472,535 | A | 10/1969 | Kinley | 285/145 |
| 3,513,511 | A | 5/1970 | Crickmer | 24/263 |
| 3,514,822 | A | 6/1970 | Guier | 24/263 |
| 3,531,836 | A | 10/1970 | Crickmer | 24/263 |
| 3,571,865 | A | 3/1971 | Johnson | 24/263 |
| 3,579,752 | A | 5/1971 | Brown | 24/263 |
| 3,579,753 | A | 5/1971 | Pryor | 24/263 |
| 3,675,278 | A | 7/1972 | Powell | 24/249 |
| 3,739,434 | A | 6/1973 | Wheeler | 24/249 |
| 3,742,563 | A | 7/1973 | Brown | 24/263 |
| 3,742,582 | A | 7/1973 | Broske | 29/421 |
| 3,748,702 | A | 7/1973 | Brown | 24/263 |
| 3,846,877 | A | 11/1974 | Spiri | 24/263 |
| 3,961,399 | A | 6/1976 | Boyadjieff | 24/263 |
| 3,999,260 | A | 12/1976 | Stuckey et al. | 24/263 |
| 4,093,042 | A | 6/1978 | Pradon | 188/67 |
| 4,203,182 | A | 5/1980 | Boyadjieff | 24/263 |
| 4,253,219 | A | 3/1981 | Krasnov | 24/263 |
| 4,269,277 | A | 5/1981 | Baugh | 173/149 |
| 4,275,487 | A | 6/1981 | Gray et al. | 24/263 |
| 4,275,488 | A | 6/1981 | Gray et al. | 24/263 |
| 4,281,535 | A | 8/1981 | Wesch | 73/49.8 |
| 4,306,339 | A | 12/1981 | Ward | 24/263 |
| 4,306,742 | A | 12/1981 | Hardcastle | 285/147 |
| 4,332,062 | A | 6/1982 | Byrne | 24/263 |
| 4,333,209 | A | 6/1982 | Herst | 24/263 |
| 4,351,090 | A | 9/1982 | Clements et al. | 24/263 |
| 4,355,443 | A | 10/1982 | Blackwell | 24/263 |
| 4,361,940 | A | 12/1982 | McFadden | 24/263 |
| 4,389,760 | A | 6/1983 | Krasnov | 24/263 |
| 4,415,193 | A | 11/1983 | Carlberg | 294/102 |
| 4,450,606 | A | 5/1984 | Broussard | 188/67 |
| 4,511,168 | A | 4/1985 | Haynes | 294/102.2 |
| 4,576,254 | A | 3/1986 | Cox | 188/67 |
| 4,681,193 | A | 7/1987 | Crowe | 188/67 |
| 4,711,326 | A | 12/1987 | Baugh | 188/67 |
| 4,715,456 | A | 12/1987 | Poe et al. | 175/423 |
| 4,791,997 | A | 12/1988 | Krasnov | 175/57 |
| 4,823,919 | A | 4/1989 | Hayatdavoudi | 188/67 |
| 4,934,869 | A | 6/1990 | Brandon et al. | 405/199 |
| 4,940,118 | A | 7/1990 | Cox | 188/67 |
| 5,027,926 | A | 7/1991 | Cox | 188/67 |
| 5,174,397 | A | 12/1992 | Currington | 174/423 |
| 5,335,756 | A | 8/1994 | Penisson | 188/67 |
| 5,451,084 | A | 9/1995 | Jansch | 294/1.1 |
| 5,484,040 | A | 1/1996 | Penisson | 188/67 |
| 5,609,226 | A | 3/1997 | Penisson | 188/67 |
| 5,848,647 | A | 12/1998 | Webre et al. | 166/379 |
| 5,971,086 | A | 10/1999 | Bee et al. | 175/423 |
| 5,992,801 | A | 11/1999 | Torres | 248/49 |
| 6,089,338 | A | 7/2000 | Bouligny | 175/423 |
| 6,264,395 | B1 * | 7/2001 | Allamon et al. | 403/367 |

* cited by examiner

SLIPS FOR DRILL PIPES OR OTHER TUBULAR MEMBERS

CROSS-REFERENCE TO RELATED APPLICATION

The present application is a continuation of U.S. patent application Ser. No. 09/863,691 filed May 23, 2001 which in-part claimed the benefit of the filing date of U.S. Provisional Patent Application Serial No. 60/180,361 filed Feb. 4, 2000.

BACKGROUND OF THE INVENTION

1. Field of the Invention

The present invention generally relates to apparatus for holding pipe or other tubular members in a vertical position, and, particularly, to apparatus which is useful in oilfield operations for drilling, setting casing, or placing or removing any tubular member from a wellbore. The present invention increases the strength of drill pipe slip assemblies.

2. Description of the Prior Art

In the drilling or workover of oil and gas wells, it is necessary to thread together numerous links of tubular goods, or pipe. These tubular members may, for example, comprise either a drill string which rotates a bit at the bottom thereof, or a pipe conduit such as production tubing or well casing which is placed and cemented in the wellbore to prevent its walls from collapsing. In the drilling operation, at least some of the weight of the pipe string extending into the well bore is supported by a traveling block and tackle arrangement from a derrick which extends upwardly from the floor of the drilling rig.

When it is necessary to add or remove additional pipe to or from the top end of the drill string, the rotary motion of the drill string is stopped and it is suspended at the floor of the drilling rig while an additional pipe section is threadedly connected to the uppermost pipe section in the drill string. Alternatively, it may be unthreaded and removed from the uppermost pipe section in the drill string. In these instances, the drill string is typically suspended by a drill slip assembly comprising a slip bowl assembly which is mounted in the floor of the drilling rig and through which the drill string extends downwardly into the borehole. The slip bowl assembly has a bore through which the pipe at the upper end of the drill string extends. The slip bowl assembly usually includes a tapered bore such that the bowl is smaller in diameter at the bottom than at the top. The drill slip assembly also comprises a plurality of slip segments (typically three), and the inner portion of each slip segment has a plurality of axial rows of dies, which are gripping elements. The slip segments have an outer taper matches the taper of the bowl. When the slip segments are installed in the slip bowl, inner portions of the slip segments form a cylindrical surface with the gripping elements directed toward the tubular member to be contained in the slip bowl assembly. When the pipe is lowered within the interior of the slip bowl assembly, a camming action between the slip segments of the assembly, and their respective dies, forces the slip segments, and their respective dies inwardly into the pipe, thus gripping it and suspending it from the slip bowl assembly. The slip segments, when installed in the slip bowl, form a cylindrical hole in the center that is roughly the same size as the drill pipe. The slip segments, with their gripping dies protruding radially inward, are manually lowered into the annulus between the bore of the bowl and the drill string when it is desired to suspend the drill string. The assembly naturally grips onto the pipe as it is wedged in the annular taper angle formed between the bowl and the slip segments. When drill pipe is so suspended, an additional joint of pipe may be threadably engaged with the uppermost pipe section on the drill string. The slip segment dies are then removed from engaging contact, and rotary motion is imparted to the drill string to continue drilling.

Also during the drilling operation it may be necessary to remove the drill string to change the bit, to add casing to a portion of the well, or for other reasons. While removing the drill string, rotary motion is stopped and the drill string is suspended in the slip bowl assembly. Thereafter, an elevator which is suspended from the traveling block, in the block and tackle arrangement mentioned previously, is used to grip the pipe just above the slip bowl assembly and the slip segment dies of the slip bowl assembly are disengaged. The traveling block is then raised, the slip bowl assembly slips are reset and the stand pipe extending above the drilling rig floor may be unthreaded and removed. Thereafter, the elevator grasps the pipe extending from the slip bowl assembly, the slip bowl assembly slip segments are again released from contact, and the traveling block again raised. This process may be repeated until the drill string is entirely removed from the wellbore.

Within each slip segment, the axial rows of hardened dies are located for contact with the drill pipe surface. Typically each slip segment has three axial rows of six dies for a total of eighteen hardened dies secured within each slip segment. These hardened dies typically include tooth profiles on the pipe interface surface that enhance the gripping capability of the dies on the pipe by actually penetrating the pipe surface slightly. The hardened dies are necessary because the contact stresses with the pipe can be quite high and the dies are subject to considerable wear.

As the oil industry seeks to drill in ever-deeper offshore waters, the length and weight of the longest drill strings in service have increased accordingly as well as the weight of the suspended loads such as casing strings and liners. As a result of the high repeated loads experienced in many of the deep well applications, bothersome cracking has been noted in the slip segments in the critical "nose" areas that support the loads from the dies. If these cracks are allowed to grow to the point of complete failure to support the dies, the result could be the loss of the drill string downhole as well as loss of the suspended load. This could result in huge remedial costs, or complete loss of the well.

U.S. patent application Ser. No. 09/596,489 ("the '489 Application"), which is incorporated herein by reference, discloses a drill slip assembly where each slip segment comprises a load ring attached to the slip segments between an upper and a lower set of dies, and this load ring absorbs stresses imparted by the upper set of dies and protects the lower set of dies from carrying these stresses. The '489 Application further discloses resilient inserts attached to the top of the uppermost dies of the upper set of dies and the uppermost dies of the lower set of dies. These resilient inserts urge the dies downward and prevent gaps from forming between the dies. Such gaps may yield an unbalanced loading condition among the dies. The apparatus described in the '489 Application achieves a more uniform distribution of the tubular member load carried by each individual slip segment and its respective dies than attainable using prior art drill slips.

The apparatus described in the '489 Application provides a substantial improvement in drill slip assemblies in that the nose area has considerable protection from cracking due to an accumulation of axial stress on the lower dies. Even with the apparatus as described in the '489 Application, however, some nose cracking has still been observed due to lateral stresses along the nose area of the drill slip segments. The nose area of prior art slip segments extends past the supporting bowl such that any lateral movement of the tubular member creates a lateral stress concentration in the nose area. These stresses create cracks along the nose area of the drill slip and cause drilling operators to replace the slips prematurely to avoid a failure of the slip entirely and resulting damage to the drill pipe and possibly the well. Therefore, a drill slip apparatus capable of protecting the nose area from cracking due to lateral stresses imparted by the drill pipe would be desirable to the oil well industry.

In addition, the apparatus described in the '489 Application utilizes a plurality of axial grooves formed in the drill slip segments to hold the hardened dies. The axial grooves are fabricated using a dovetail cutting tool which cuts a wedge-shaped groove, or dovetail groove, running from the top of the slip segment axially downward to a point just above the bottom of the slip segment. The sides of the wedge-shaped grooves match the sides of the wedge-shaped dies. Because of the shape of the tool, the bottom of the axial groove is rounded with an angled profile, and does not complement the flat bottom of the hardened dies described in the '489 Application. Therefore, to support the lowermost set of dies which engage the bottom of the axial grooves, prior art assemblies used a half-moon insert which was welded to the bottom of the axial groove. The top of the half-moon insert was flat and complements the bottom of the lowermost set of dies. The bottom of the half-moon insert was rounded and complements the bottom of the axial groove. However, weld failures have been observed on the half-moon inserts during loading operations causing the lowermost set of dies to lose structural support. Therefore, a drill slip apparatus capable of adequately supporting the lowermost set of hardened dies without the use of welded inserts would also be desirable to the oil well industry.

SUMMARY OF THE INVENTION

Apparatus in accordance with the present invention is an improvement over the apparatus disclosed in the '489 Application in the following ways. First, the outward tapered surface of the slip segments is in full contact with the tapered bore of the slip bowl assembly. This result is realized by insuring that the smallest diameter of the slip segment assembly is greater than or equal to the smallest diameter of the tapered bore of the slip bowl assembly.

Second, slip segments in accordance with the present invention are fabricated from forged steel. By using forged steel components, the slip segments function with more durability and with greater load bearing capacity than prior art slip segments fabricated from castings.

Third, in accordance with the present invention, each die in the lowermost set of hardened dies is fabricated having a rounded bottom end with a tapered profile. The rounded end and tapered profile match the shape of the bottom of the axial grooves. This provides full support to the bottom of the lowermost set of hardened dies and precludes the need to weld half-moon inserts to the bottom of the axial grooves.

DETAILED DESCRIPTION OF SPECIFIC EMBODIMENTS

A description of certain embodiments of the present invention is provided to facilitate an understanding of the invention. This description is intended to be illustrative and not limiting of the present invention. A preferred embodiment of the slip assembly of the present invention is described with respect to its use on a drilling rig. However, it is intended that the slip assembly of the present invention can be utilized for any operation where a tubular member is required to be held substantially motionless in a vertical position.

Figure 1:
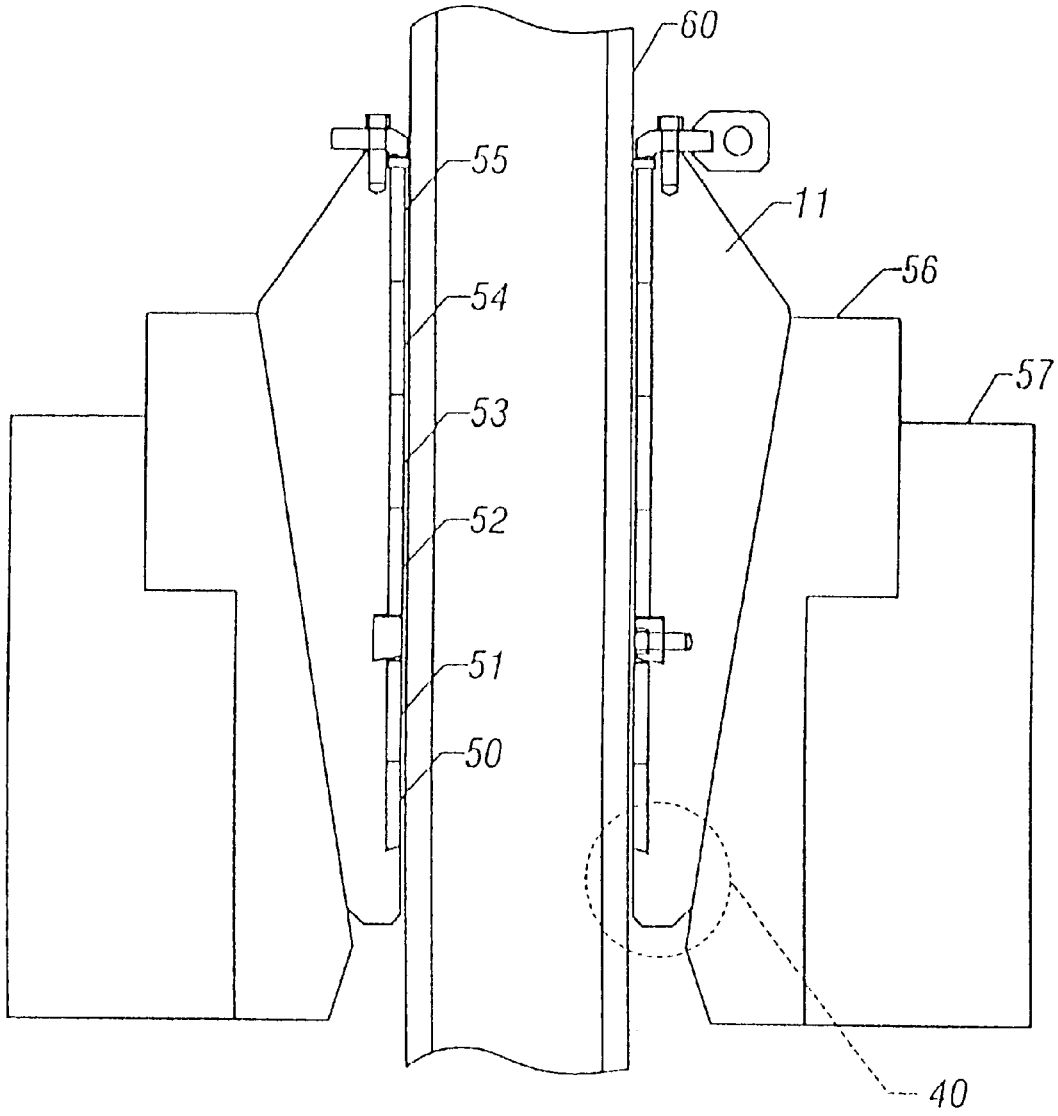
FIG. 1 is an elevation view of an embodiment of the present invention for holding up pipe or other tubular members in a vertical position.

With reference to FIG. 1, apparatus in accordance with the present invention comprises slip bowl 56 which is supported by a rotary table 57. The inner surface of the slip bowl 56 resembles a truncated cone and tapers from a larger diameter at the top to a smaller diameter at the bottom. A slip segment assembly 11 comprises a plurality of slip segments S1, S2, and S3 (see FIG. 8), and the outer surfaces of these slip segments engage the inner surface of bowl 56. While a preferred embodiment of the present invention utilizes a slip segment assembly comprising three slip segments, any suitable number of slip segments S1, S2, and S3 may be used to form the slip segment assembly.

The outer surface of slip segment assembly 11 tapers radially inward at the same angle as bowl 56. The inner surface of bowl 56 and the outer surface of slip segment assembly 11 are preferably angled 9 to 10 degrees with respect to vertical axis of the tubular member. The smallest diameter of the outer surface of slip segment assembly 11 at nose area 40 is equal to or greater than the smallest diameter of the inner surface of bowl 56. This prevents any portion of the slip segment assembly 11 from extending below the bowl 56 and provides full support for the nose area 40 by the slip bowl.

Still with reference to FIG. 1, the inner surface of slip segment assembly 11 defines a bore whose diameter is substantially the same as the diameter of drill pipe 60. While a preferred embodiment of the present invention provides an apparatus for holding a drill pipe, it is intended that an apparatus of the present invention may be used to hold any tubular member.

Figure 2:
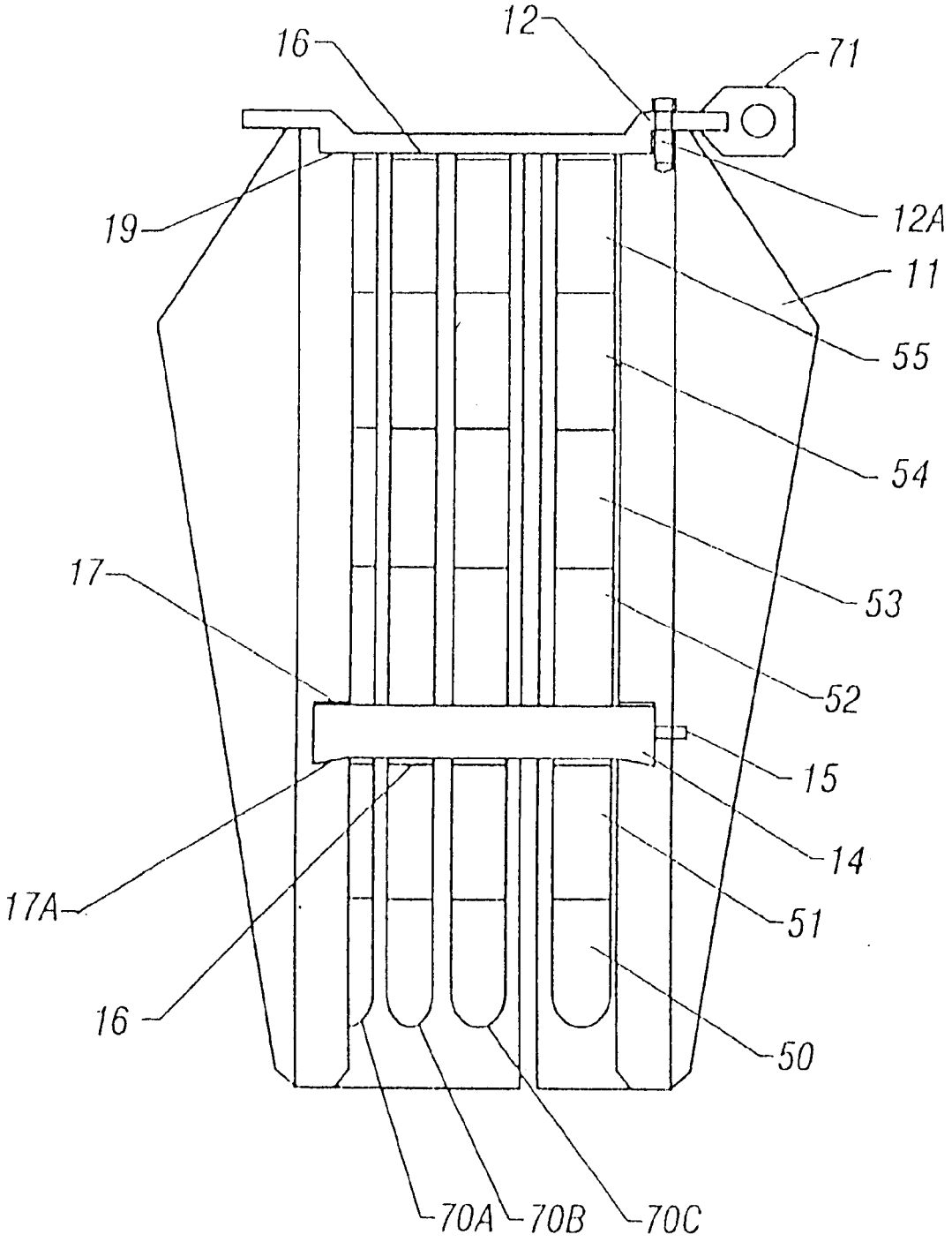
FIG. 2 is an enlarged section view of the slip segments with the hardened dies, retainer ring, and load ring installed.
Figure 3A:
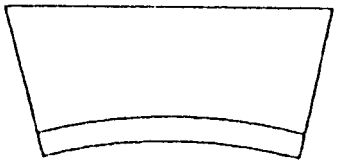
FIG. 3A is an enlarged view of the top of an individual hardened die.
Figure 4A:
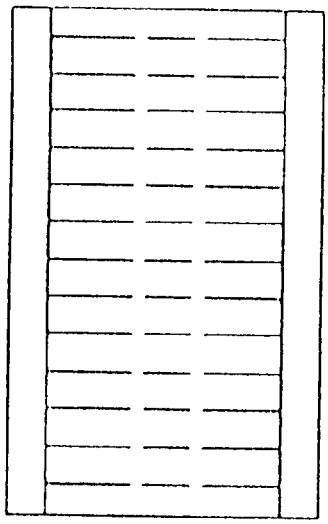
FIG. 4A is an enlarged view of the front of a single hardened die.
Figure 4B:
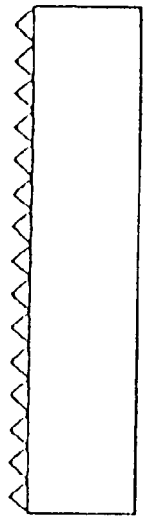
FIG. 4B is an enlarged view of the side of a single hardened die having a tooth-like profile.
Figure 5A:
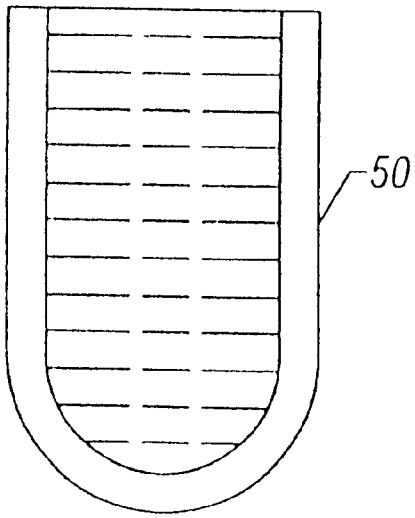
FIG. 5A is an enlarged view of the front of a single hardened die having a rounded bottom end.
Figure 5B:
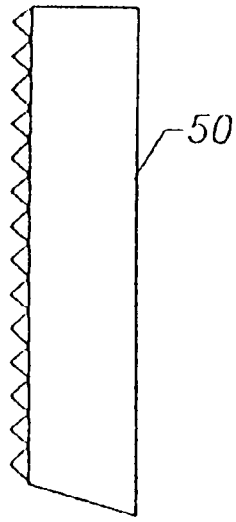
FIG. 5B is an enlarged view of the side of a single hardened die having tooth-like gripping elements and a profile that tapers to a point at the bottom.
Figure 8:
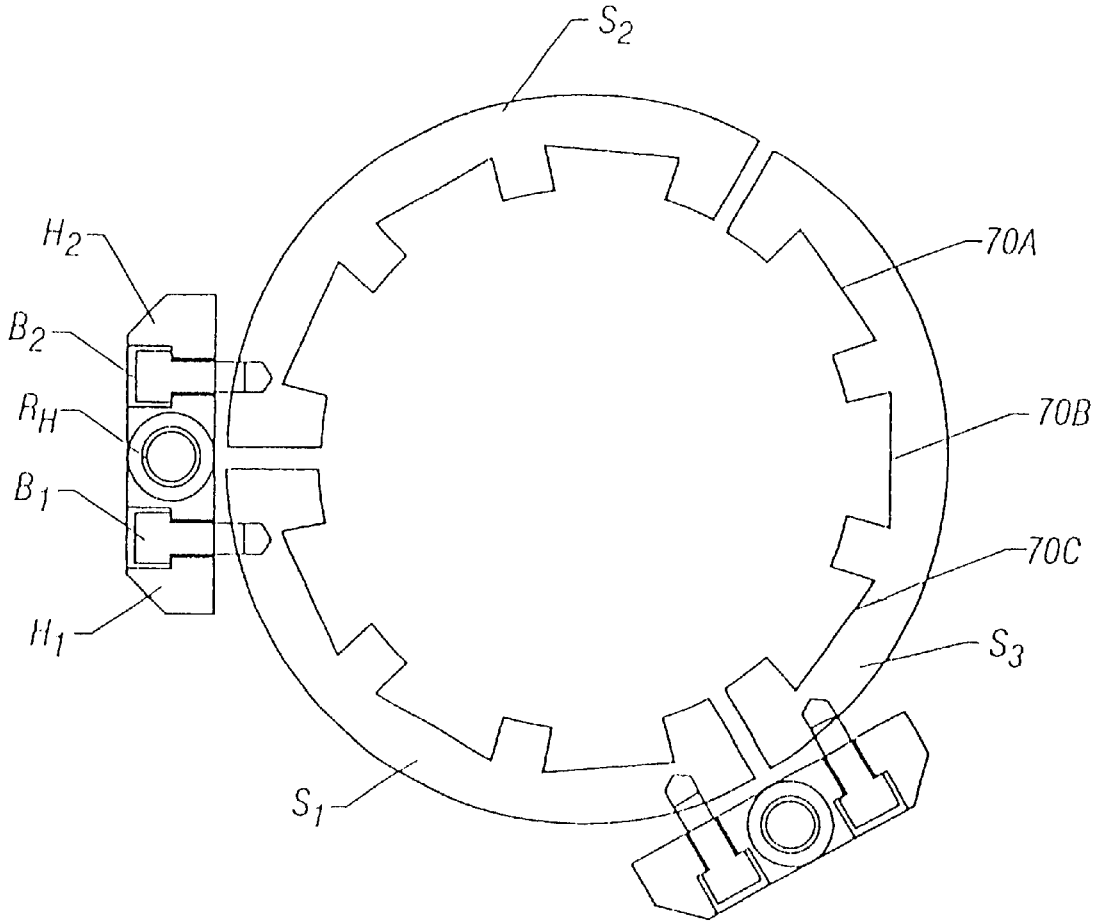
FIG. 8 is a top view of slip segments assembled with hinge connections.

With reference to FIGS. 2 and 8, each of the three slip segments S1, S2, and S3 of the slip assembly 11 has three vertical wedge-shaped grooves 70A, 70B, and 70C. Each of the vertical grooves 70A, 70B, and 70C holds six hardened dies and a load ring 14. Two sets of lower hardened dies 50 and 51 are below load ring 14, and four sets of upper hardened dies 52, 53, 54, and 55 are above load ring 14. Thus, there are preferably a total of 54 hardened dies for the entire slip segment assembly 11. As described in the '489 Application, the load ring 14 absorbs the stress from the upper dies 52, 53, 54, and 55 in each slip segment S1, S2, and S3 and prevents the stress from accumulating in the lower dies 50 and 51 located in the nose area 40 of each slip segment. In plan, each individual die has a wedge-like shape (see FIG. 3A) which complements the shape of the grooves 70A, 70B, and 70C of slip segment assembly 11. In profile, each individual die has a tooth-like surface (see FIG. 4B) protruding radially inward for gripping the tubular member 60 and arresting axial displacement of the tubular member. The lowermost hardened dies 50 have rounded bottom ends which are cut at an angle to complement the shape of the axial grooves 70A, 70B, and 70C and to provide uniform distribution of load imparted into the nose area 40 of slip segment assembly 11 (see FIGS. 5A and 5B). The remaining hardened dies 51, 52, 53, 54, and 55 have flat bottom ends (see FIGS. 4A and 4B).

Figure 6A:
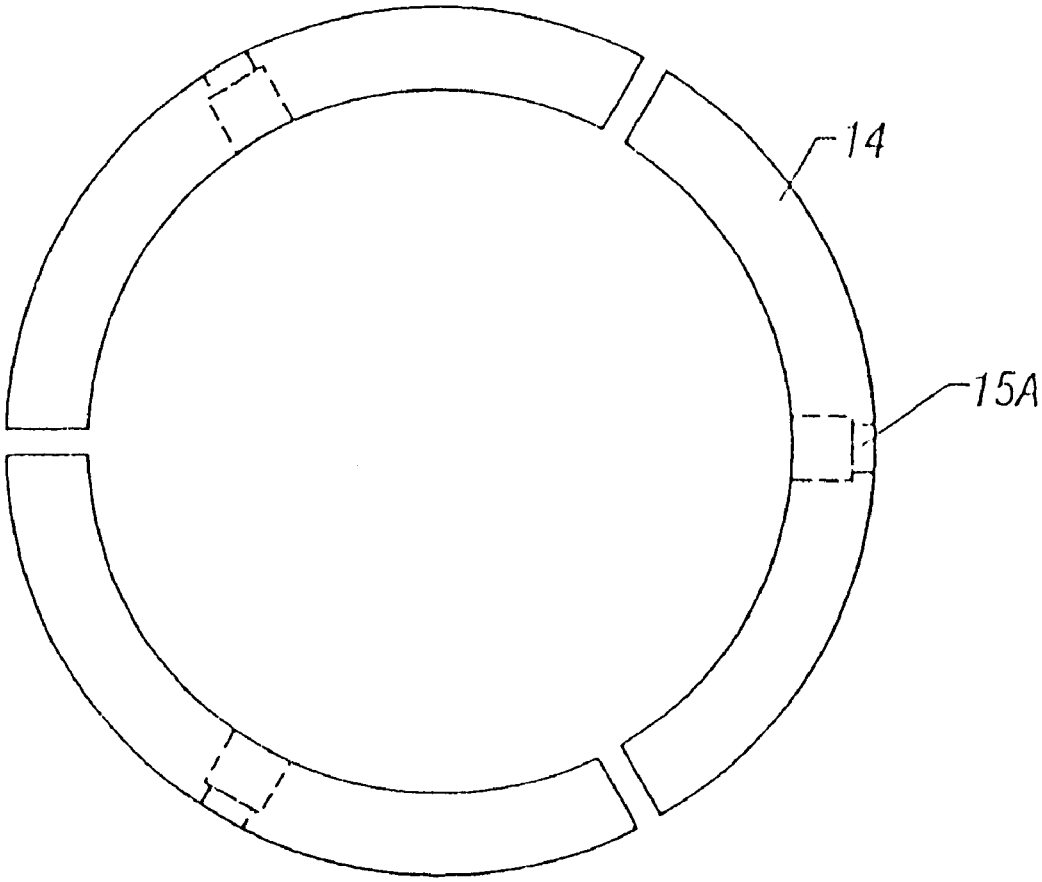
FIG.6A is a plan view of a load ring assembly having three segments with lateral bolt holes bore through for connection with drill slip segments.
Figure 6B:
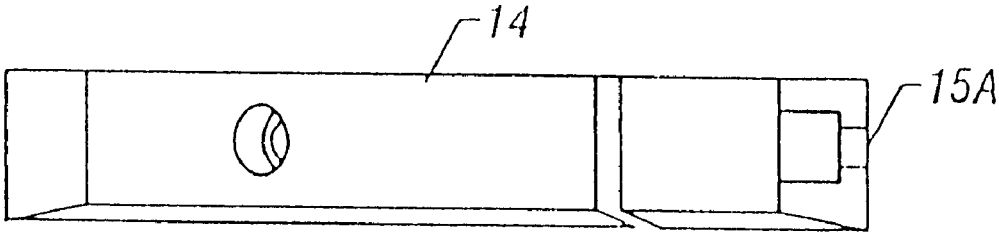
FIG. 6B is a profile view of a load ring assembly having three segments with lateral bolt holes bore through for connection with drill slip segments.

With reference to FIGS. 2, 6A, and 6B, the load ring 14 for each slip segment comprises a 120 degree segment as illustrated. Each load ring 14 is provided with a retaining bolt hole 15A. Each bolt hole 15A carries a retaining bolt 15 which holds each load ring 14 in its respective slip segment S1, S2, and S3. A circumferential groove is formed in each slip segment S1, S2, and S3 to receive load ring 14. The circumferential groove 17 is cut at a reverse angle 17A of approximately 10 degrees. The load ring 14 is also cut at a reverse angle of approximately 10 degrees to complement circumferential groove 17. This prevents the load ring from being removed perpendicular to the slip segment.

Figure 7A:
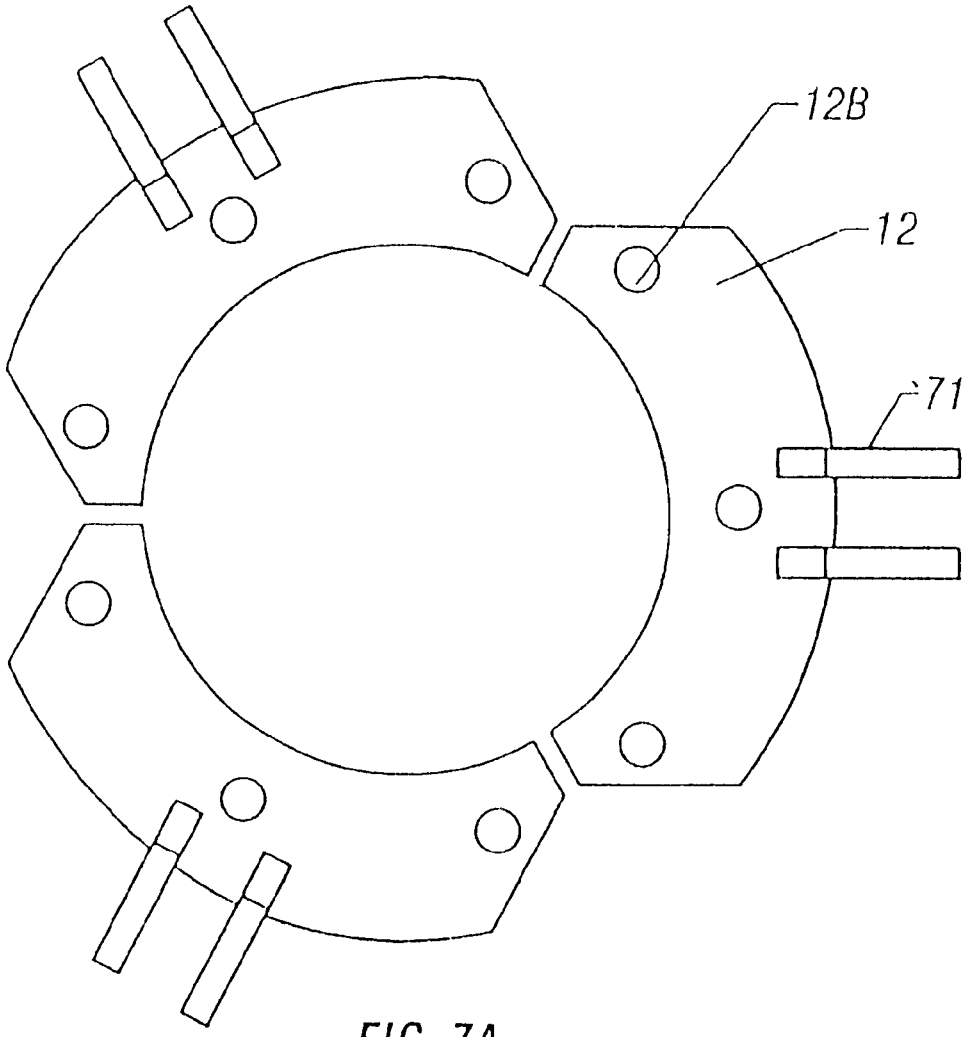
FIG. 7A is a plan view of a retainer ring and lifting lugs assembly having three segments with longitudinal bolt holes bore through for connection with drill slip segments.
Figure 7B:
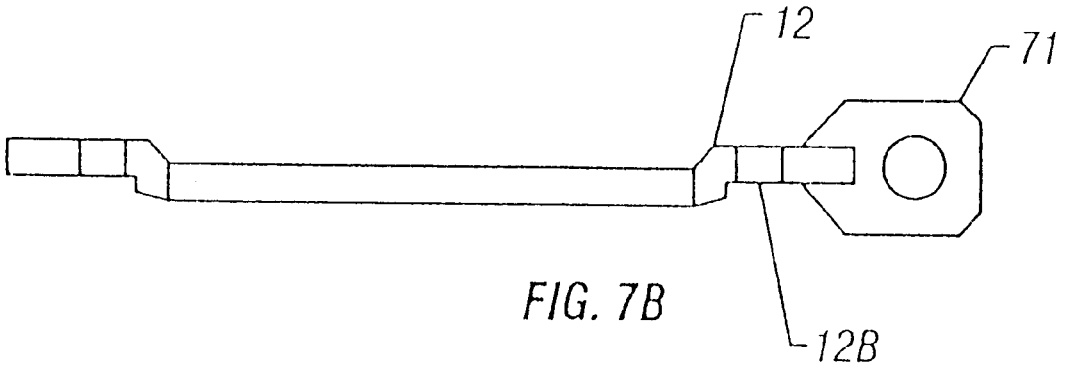
FIG. 7B is a profile view of a retainer ring and lifting handle assembly having three segments with longitudinal bolt holes bore through for connection with drill slip segments.

With reference to FIGS. 2, 7A, and 7B, a retainer ring 12 comprises three symmetrical 120 degree segments, each having three bolt holes 12B and two lifting lugs 71. The retainer ring 12 fits in circumferential bore 19 of slip segment assembly 11 and is attached to the slip segment assembly by throughbolts 12A. The retainer ring 12 is locked above the hardened dies 50, 51, 52, 53, 54, and 55 and prevents the dies from moving upward out of the wedge-shaped grooves 70A, 70B, and 70C of slip segment assembly 11.

Figure 3B:
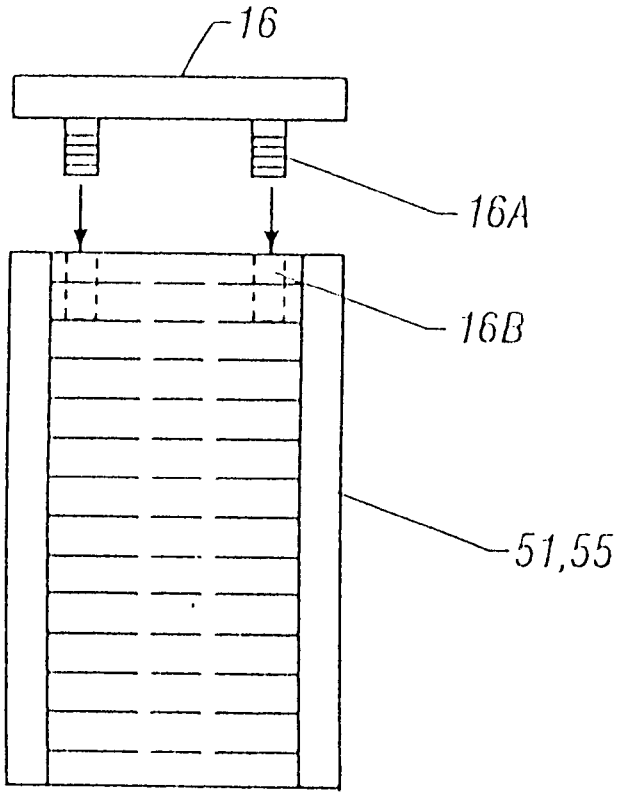
FIG. 3B is an enlarged view of the front of a single hardened die with a resilient insert attached to the top.
Figure 3C:
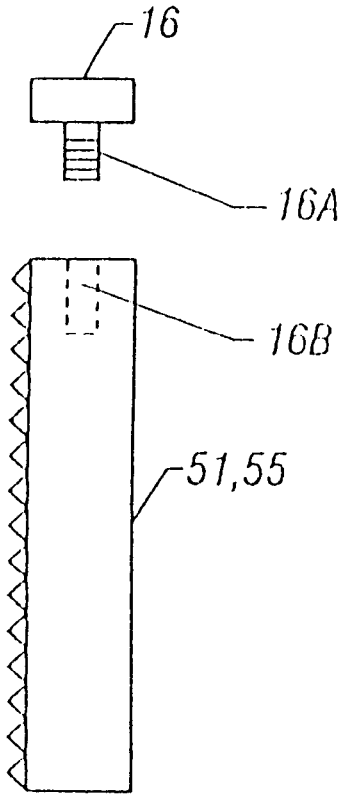
FIG. 3C is an enlarged view of the side of a single hardened die having a tooth-like profile and a resilient insert attached to the top.

With reference to FIGS. 2, 3B, and 3C, a resilient insert is attached to the top of each of the uppermost dies 51 in the lower group and each of the uppermost dies 55 in the upper group. Each of the dies 51 and 55 is provided with two holes 16B drilled into its top surface. The holes 16B are sized to snugly receive two downward protruding legs 16A of resilient insert members 16. The use two legs 16A and two holes 16B prevents twisting under load conditions of the resilient insert 16 and averts misalignment of the resilient insert 16 from the top portion of the die 51 and 55 under loading conditions. The resilient inserts 16 are formed of a plastic or elastomeric material such as a cured rubber compound or a synthetic plastic such as nylon. When the retainer ring 12 and the load ring 14 are placed into position on the slip segment assembly 11, the resilient inserts 16 urge their corresponding dies downward into the slip segment from these upper abutting surfaces. This insures that each of the slip segments in the slip segment assembly 11 are positioned properly and symmetrically about the slip bowl 56. This symmetrical distribution of the slip segment assembly 11 insures that the hardened dies 50, 51, 52, 53, 54, and 55 have uniform contact without any gaps with the exterior surface of the tubular member 60 being held in place.

Figure 9A:
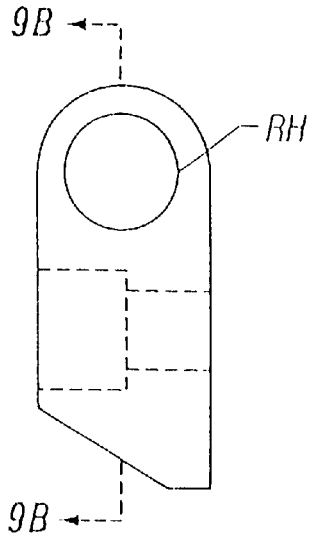
FIG. 9A is a top view of an individual hinge for connecting together drill slip segments to form drill slip assembly.
Figure 9B:
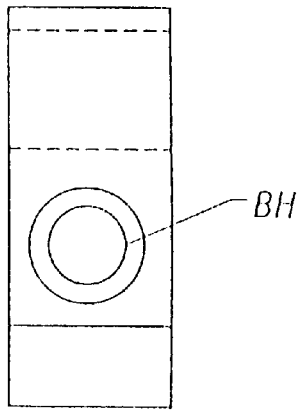
FIG. 9B is a section view of an individual hinge for connecting together drill slip segments to form drill slip assembly.

With reference to FIGS. 8, 9A, and 9B, in accordance with a preferred embodiment of the present invention, the slip segments S1 and S2 are connected by block hinges H1 and H2. The block hinges H1 and H2 are stacked upon one another such that rod holes RH are aligned and such that bolt B1 of hinge H1 is secured to slip segment S1 and bolt B2 of hinge H2 is secured to slip segment S2. While only two block hinges H1 and H2 are depicted along seam between slip segments S1 and S2, it is intended that more than two hinges can be used along the seam as long as the rod holes RH are aligned. Once the rode holes RH are aligned and the bolts B1 and B2 are secured to segments S1 and S2 respectively, a rod (not shown) is run through the aligned rod holes to pin the hinges H1 and H2 together. Slip segments S1 and S3 are also hinged together in the same manner as slip segments S1 and S2.

What is claimed is:

1. A slip assembly for handling a drill pipe on a drilling rig having a rotary table, comprising:

a slip bowl supported in the rotary table having an upper end and a lower end and a tapered axial bore therethrough for passage of the drill pipe, said tapered axial bore having a constant slope from the upper end to the lower end; and a plurality of slip segments for insertion into the slip bowl, each slip segment comprising: (i) an upper end and a lower end; (ii) a tapered outer surface which complements the taper of the axial bore of the slip bowl and engages the axial bore of the slip bowl such that the lower end of each slip segment does not extend below the bore of the slip bowl; (iii) an inner surface which defines the shape of the axial bore for passage of the drill pipe; (iv) a circumferential groove formed in the inner bore between the upper end and lower end; (v) a load ring installed in said groove; and (vi) a plurality of axial rows of dies with gripping surfaces protruding radially inward installed in each slip segment, some of the dies in each axial row being installed below the load ring and the remainder of the dies in each axial row being installed above the load ring.

2. The slip assembly of claim 1, wherein the slip segments and load ring are fabricated from forged steel.

3. The slip assembly of claim 1, further comprising a plurality of axial grooves formed in each slip segment which define the axial rows in which the dies are arranged.

4. The slip assembly of claim 3, wherein each axial groove is a dovetail-shaped groove having a rounded bottom end and the dies contained within each groove have a wedge-shaped profile complementing the dovetail-shaped groove.

5. The slip assembly of claim 4, wherein the lowermost die in each axial groove has a rounded bottom end complementing the rounded bottom end of the axial groove.

6. The slip assembly of claim 3, further comprising:

a circumferential bore formed at the top of each slip segment, said circumferential bore perpendicularly intersecting the upper end of the axial grooves formed on each slip segment; and a retainer ring inserted in the circumferential bore, said retainer ring inserted above the uppermost dies in each axial row such that the uppermost dies are in edge-to-edge contact with the retainer ring.

7. The slip assembly of claim 6, further comprising:

means for urging the dies located below the retainer ring downward away from the retainer ring and toward the load ring; and means for urging the dies located below the load ring downward away from the load ring and toward the rounded bottom end of each axial groove.

8. The slip assembly of claim 1, wherein the circumferential groove has an undercut lower side.

9. The slip assembly of claim 8, wherein the load ring has a tapered lower surface shaped complimentary to the undercut side of the circumferential groove.

10. The slip assembly of claim 9, wherein the lower surface of the load ring is tapered at an angle of about 10 degrees with respect to the upper surface of the load ring.

11. The slip assembly of claim 1, further comprising a means for connecting together the slip segments.

12. A slip assembly for preventing axial display of a drill pipe above or within a wellbore on a drilling rig having a rotary table, comprising:

a slip bowl supported in the rotary table having an upper end and a lower end and a tapered axial bore therethrough for passage of the drill pipe, said tapered axial bore having a constant slope from the upper end to the lower end;

a plurality of slip segments for insertion into the slip bowl, each slip segment comprising: (i) an upper end and a lower end; (ii) a tapered outer surface which complements the taper of the axial bore of the slip bowl and engages the axial bore of the slip bowl such that the lower end of each slip segment does not extend below the bore of the slip bowl; (iii) an inner surface which defines the shape of the axial bore for passage of the drill pipe; (iv) a circumferential groove formed in the inner bore between the upper end and lower end, said circumferential groove having an undercut lower side; (v) a plurality of dovetail-shaped axial grooves formed in each slip segment, said axial grooves having a rounded bottom end; and (vi) a circumferential bore formed at the top of each slip segment, said circumferential bore perpendicularly intersecting the upper end of the axial grooves on each slip segment;

a load ring installed in the circumferential groove and having a tapered lower surface complementary to the undercut lower side of the circumferential groove, the lower surface of the load ring being tapered at an angle of about 10 degrees with respect to the upper surface of the load ring;

a plurality of axial rows of wedge-shaped dies with gripping surfaces protruding radially inward installed within each axial groove of each slip segment, some of the dies in each axial row being installed below the load ring and the remainder of the dies in each axial row being installed above the load ring;

a retainer ring in the circumferential bore, said retainer ring inserted above the uppermost row of dies such that the uppermost row of dies are in edge-to-edge contact with the retainer;

means for urging the dies located below the retainer ring downward toward the load ring, and means for urging the dies located below the load ring downward toward the bottom end of he axial groove; and hinges for connecting slip segments together to form a slip segment assembly.

13. The slip assembly of claim 12, wherein the slip segments, load ring, and retainer ring are fabricated from forged steel.

14. A slip assembly for handling a drill pipe on a drilling rig having a rotary table, comprising:

a slip bowl supported in the rotary table, said slip bowl comprising: (i) an upper end; (ii) a lower end, said lower end having a diameter smaller than diameter of the upper end; and (iii) a tapered axial bore therethrough for passage of the drill pipe, said tapered axial bore having a constant slope from the upper end to the lower end; and a plurality of slip segments for insertion into the slip bowl to handle the drill pipe, each slip segment comprising: (i) an upper end and a lower end; (ii) a tapered outer surface which complements the constant slope of the tapered axial bore of the slip bowl; (iii) an inner surface which defines the shape of the axial bore for passage of the drill pipe; (iv) a circumferential groove formed in the inner bore between the upper end and lower end; (v) a load ring installed in the groove; and (vi) a plurality of axial rows of dies with gripping surfaces protruding radially inward installed in each slip segment, some of the dies in each axial row being installed below the load ring and the remainder of the dies in each axial row being installed above the load ring.

15. The slip assembly of claim 14, wherein each slip segment engages the axial bore of the slip bowl such that the lower end of each slip segment does not extend below the bore of the slip bowl.

16. The dip assembly of claim 15, wherein the slip segments and load ring are fabricated from forged steel.

* * * * *